US005327453A

United States Patent [19]

Arthur et al.

[11] Patent Number: 5,327,453

[45] Date of Patent: Jul. 5, 1994

[54] DEVICE FOR RELIEF OF THERMAL STRESS IN SPRAY COOLED FURNACE ELEMENTS

[75] Inventors: Mark T. Arthur, Lakewood; Gordon R. Roberts, North Olmsted, both of Ohio

[73] Assignee: Ucar Caron Technology Corporation, Danbury, Conn.

[21] Appl. No.: 995,089

[22] Filed: Dec. 23, 1992

[51] Int. Cl.[5] ..... F27D 1/12

[52] U.S. Cl. ..... 373/74; 373/73; 219/93

[58] Field of Search ..... 373/71, 73-76; 122/6 A, 6 C; 164/418, 412; 432/238, 250; 266/241, 280, 159; 110/335, 331; 219/93, 124.34

[56] References Cited

U.S. PATENT DOCUMENTS

| | | | |
|---|---|---|---|
| 4,011,651 | 3/1977 | Bradbury et al. | 29/424 |
| 4,304,396 | 12/1981 | Udoh | 266/193 |
| 4,559,011 | 12/1985 | Gritsuk et al. | 432/233 |
| 4,637,034 | 1/1987 | Grageda | 373/76 |
| 4,715,042 | 12/1987 | Heggart et al. | 373/74 |
| 4,815,096 | 3/1989 | Burwell | 373/74 |
| 4,849,987 | 7/1989 | Miner, Jr. et al. | 373/74 |
| 4,903,640 | 2/1990 | Howard | 122/6 A |

*Primary Examiner*—Bruce A. Reynolds
*Assistant Examiner*—Tu Hoang
*Attorney, Agent, or Firm*—F. J. McCarthy

[57] ABSTRACT

A preformed assembly is provided for the replacement of a thermally stressed portion of a unitary water cooled closure element, e.g. made of plain carbon steel, of a furnace system which includes a steel frame to which is pre-welded a copper covering plate, the steel frame being welded into a closely fitting cut-out in the closure element, e.g. a furnace roof or furnace shell.

5 Claims, 6 Drawing Sheets

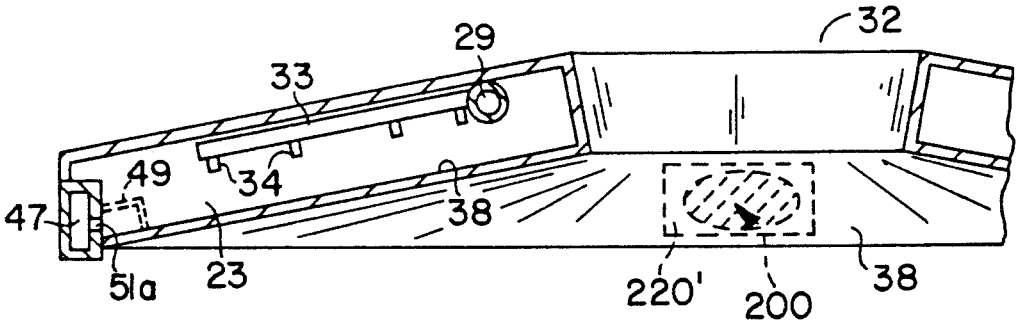
FIG. 2a
FIG. 4
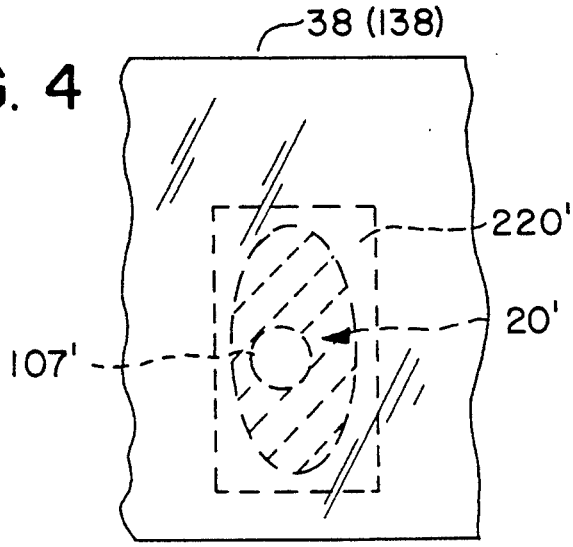
FIG. 5
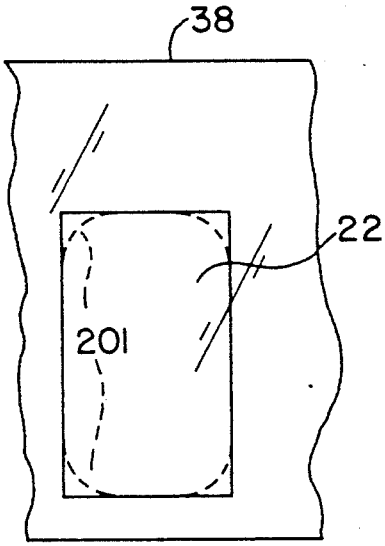
FIG. 5a
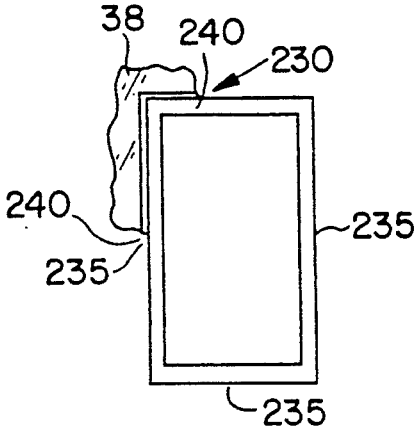

DEVICE FOR RELIEF OF THERMAL STRESS IN SPRAY COOLED FURNACE ELEMENTS

BACKGROUND OF THE INVENTION

This invention relates to spray cooled furnace systems, e.g. electric arc furnace systems, and more particularly to an assembly for inclusion in a closure member of the furnace system to provide relief of thermal stress at the site of inclusion of the assembly in the closure member.

Spray cooled electric furnace systems of the type disclosed in U.S. Pat. Nos. 4,715,042, 4,815,096 and 4,849,987 involve the spray cooling of furnace closure elements, e.g. roofs and side walls, which are unitary, i.e. formed into one piece, and have a generally frusto-conical shape in the case of roofs, or generally cylindrical or oval in the case of a furnace side wall or other closure element. Due to the geometry of furnace electrodes and oxygen lances, variations in heating of the furnace, and the like, a particular relatively discrete region of the surface of a spray cooled closure element can be exposed to unusually high temperature and become thermally stressed with the risk of failure at such region.

Since the furnace systems as above described have unitary, one-piece, carbon steel closure elements, it is not possible to use replaceable, removable sections or panels of different, e.g. higher thermal conductivity to address the situation.

It is therefore an object of the present invention to provide means for relieving thermal stress in a unitary spray cooled steel closure element of a furnace system.

SUMMARY OF THE INVENTION

An assembly including a steel frame made from a steel plate and a copper plate pre-welded thereto is closely fitted into a cut-out portion of a unitary steel closure member at a location which is exposed to radiant heat from inside the furnace, and the steel frame is welded to the closure member to provide a gas tight and water tight seal therewith, the assembly providing higher heat conductivity at the site of the cut-out region thereby relieving thermal stress and minimizing the risk of failure due to thermal stress.

BRIEF DESCRIPTION OF THE DRAWINGS

FIG. 2*a* is a cross sectional view along the line 2*a*–2*a* of FIG. 2 also showing a partial elevation view of the furnace roof and, in phantom, a thermally stressed region and proposed cut-out portion of the furnace roof;

FIG. 4 is a partial elevation view taken in a direction perpendicular to the inner plate of the furnace roof shown in FIG. 2*a* further illustrating the high thermal stress region and cut-out portion;

FIG. 5 shows a cut-out in the plate of the view of FIG. 4;

FIG. 5*a* shows a steel frame for use in a particular embodiment 5 of the present invention;

DETAILED DESCRIPTION OF THE INVENTION

Figure 1:
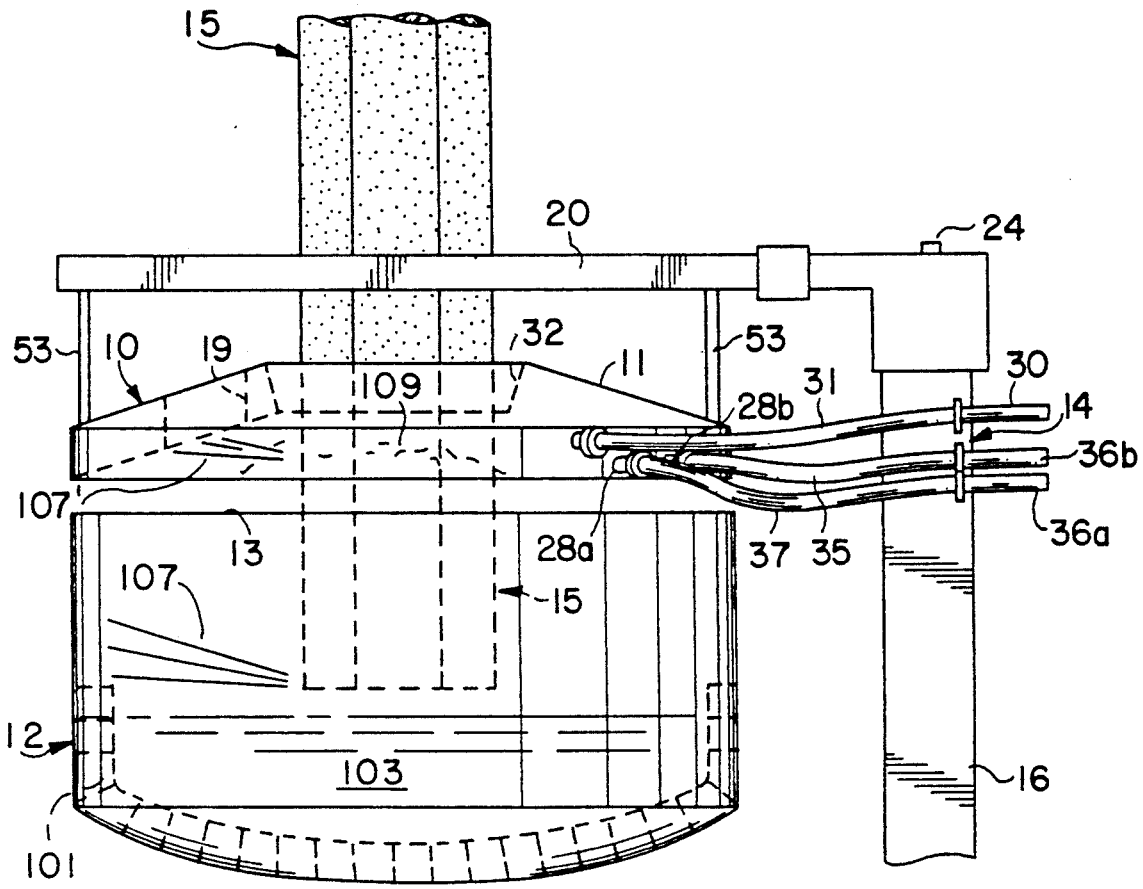
FIG. 1 is a side elevational view of a typical electric furnace installation showing a furnace vessel, a furnace roof in a raised position over the furnace vessel and a mast supporting structure for the roof.
Figure 2:
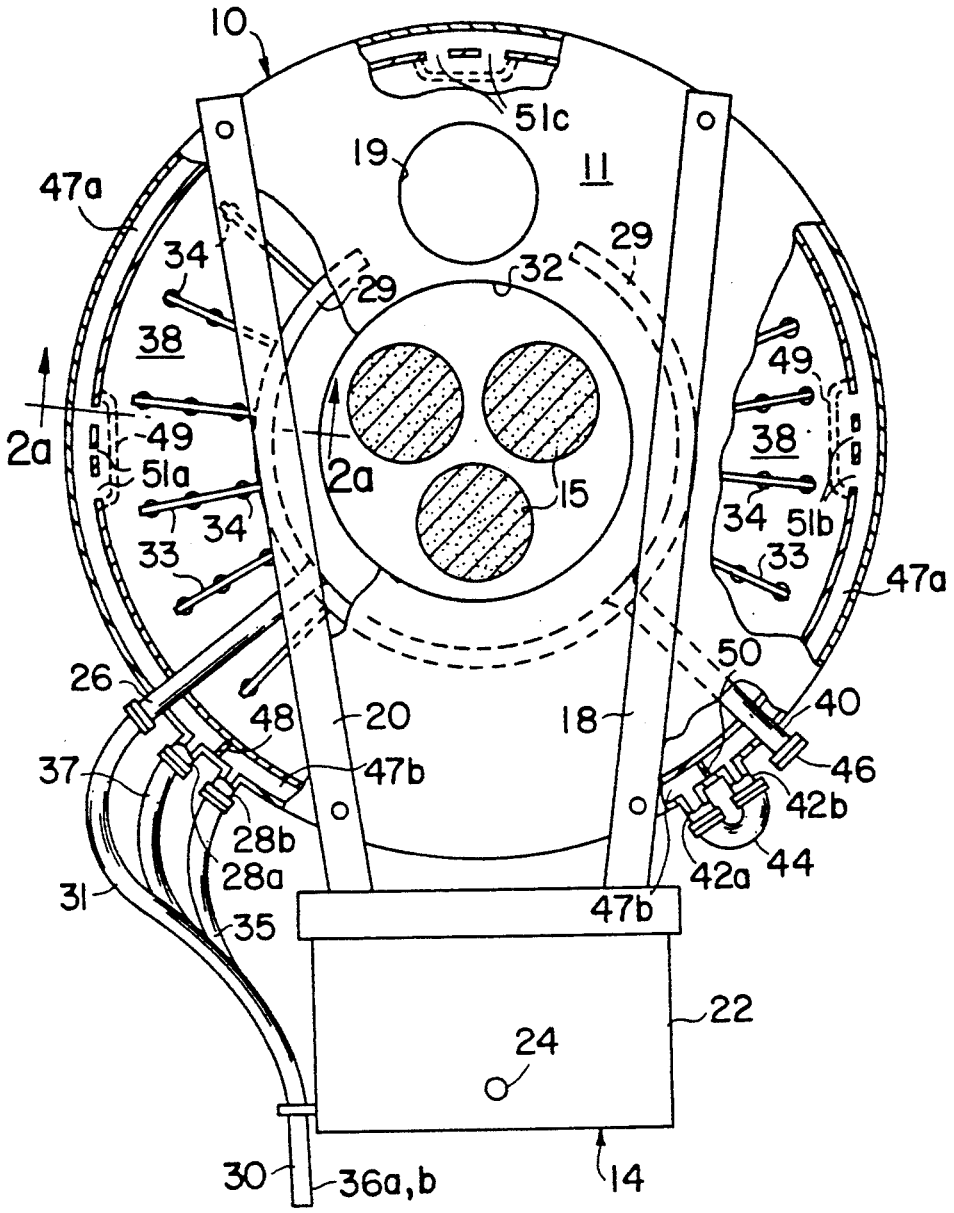
FIG. 2 PRIOR ART
FIG. 2 is a top plan view, partially cut away and partially in section, of a spray cooled furnace roof of FIG. 1.
Figure 3:
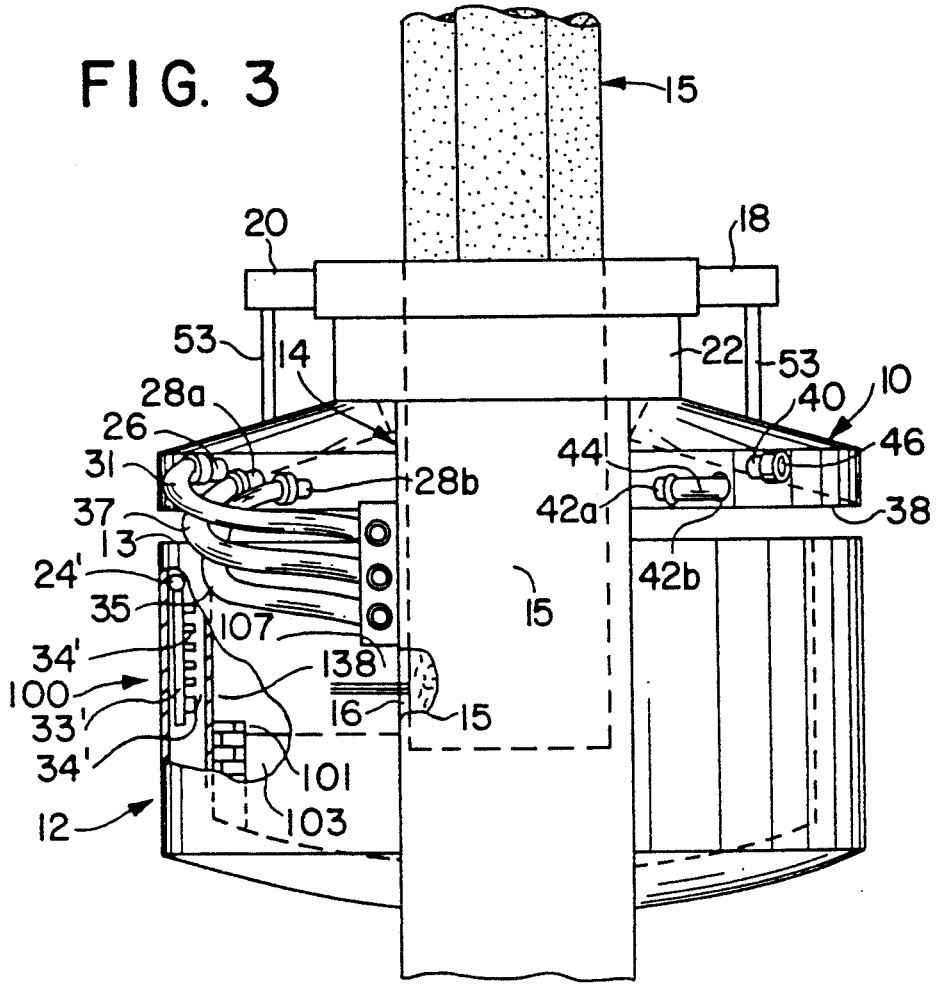
FIG. 3 is a end elevational view, partly in section, of the electric furnace installation of FIG. 1 also showing the refractory lined molten metal-containing portion of the furnace vessel and furnace side wall spray cooling components similar to those of the furnace roof of FIG. 2*a;*

FIGS. 1–3*a* illustrate a spray cooled electric furnace installation as used for steel making, although the spray cooled furnace roof system can be utilized in any type of molten material processing vessel. FIGS. 1, 2 and 3 illustrate a spray cooled electric arc furnace installation of the type shown in U.S. Pat. No. 4,849,987—F. H. Miner and A. M. Siffer, in side, top and end views, respectively. The circular water cooled furnace roof 10 is shown being supported by a furnace mast structure 14 in a slightly raised position directly over the rim 13 of electric arc furnace vessel 12. As shown in FIGS. 1 and 2, the roof 10 is a unitary, integral i.e. one-piece closure component of frusto-conical shape which is attached by chains, cables or other roof lift members 53 to mast arms 18 and 20 which extend horizontally and spread outward from mast support 22. Mast support 22 is able to pivot around point 24 on the upper portion of vertical mast post 16 to swing roof 10 horizontally to the side to expose the open top of furnace vessel 12 during charging or loading of the furnace, and at other appropriate times during or after furnace operation. Electrodes 15 are shown extending into opening 32 from a position above roof 10. During operation of the furnace, electrodes 15 are lowered through electrode ports of a delta in the central roof opening 32 into the furnace interior to provide the electric arc-generated heat to melt the charge. Exhaust port 19 permits removal of fumes generated from the furnace interior during operation.

The furnace system is mounted on trunnions or other means (not shown) to permit the vessel 12 to be tilted in either direction to pour off slag and molten steel.

The furnace roof system shown in FIGS. 1, 2 and 5 is set up to be used as a left-handed system whereby the mast 14 may pick up the unitary, one-piece roof 10 and swing it horizontally in a counterclockwise manner (as seen from above) clear of the furnace rim 13 to expose the furnace interior although this is not essential to the present. invention which is applicable to all types of electric furnaces or other furnaces which include spray cooled surfaces. To prevent excessive heat buildup on the lower steel surface 38 of roof 10 as it is exposed to the interior of furnace vessel 12, a roof cooling system is incorporated therein. A similar cooling system is shown at 100 in FIG. 3 and FIG. 3*a* for a furnace side wall 138 in the form of a unitary, one-piece cylindrally shaped shell. Refractory liner 101 below cooling system 100 contains a body of molten metal 103. The cooling system utilizes a fluid coolant such as water or some other suitable liquid to maintain the furnace roof side wall or other unitary closure element at an acceptable temperature. The systems described in the aforementioned U.S.

Pat. No. 4,715,042, U.S. Pat. No. 4,815,096 and U.S. Pat. No. 4,849,987, the disclosure of which is incorporated herein by reference are preferred, although other cooling systems can readily take advantage of the present invention. Coolant inlet pipe 26 and outlet pipes 28*a* and 28*b* comprise the coolant connection means the illustrated left-handed configured furnace roof system. An external circulation system (not shown) utilizes coolant supply pipe 30 and coolant drain pipes 36*a* and 36*b*, respectively, to supply coolant to and drain coolant from the coolant connection means of roof 10 as shown in FIGS. 1–3. The coolant circulation system normally comprises a coolant supply system and a coolant collection system, and may also include coolant recirculation means.

Attached to coolant supply pipe 30 is flexible coolant supply hose 31 which is attached by quick release coupling or other means to coolant inlet pipe 26 on the periphery of furnace roof 10. As shown best if FIGS. 2 and 2*a*, inlet 26 leads to an inlet manifold 29 which extends around central delta opening 32 in the unpressurized interior of roof 10 or inlet manifold 29' which extends around furnace 13 as shown in FIG. 3. Branching radially outward from manifold 29 in a spoke like pattern is a plurality of spray header pipes 33 to deliver the coolant to the various sections of the roof interior 23. Protruding downward from various points on each header 33 is a plurality of spray nozzles 34 which direct coolant in a spray or fine droplet pattern to the upper side of roof lower panels 38, which slope gradually downwardly from center portion of the roof to the periphery. The cooling effect of the spray coolant on the lower steel surface 38 of roof 10, and on the outer surface of steel surface 138 of furnace 13 enables the temperature thereon to be maintained at a predetermined temperature range, which is generally desired to be less than the boiling point of the coolant (100° C., in the case of water).

After being sprayed onto the roof lower panels 38, the spent coolant drains by gravity outwardly along the top of roof lower panels 38 and passes through drain inlets or openings 51*a*, 51*b* and 51*c* in a drain system. The drain system shown is a manifold which is made of rectangular cross section tubing or the like divided into segments 47*a* and 47*b*. A similar drain system (not shown) is provided for furnace 13. As seen in FIG. 2, drain openings 51*a* and 51*b* are on opposite sides of the roof. The drain manifold takes the form of a closed channel extending around the interior of the roof periphery at or below the level of roof lower panels 38 and is separated by partitions or walls 48 and 50 into separate draining segments 47*a* and 47*b*. Drain manifold segment 47*a* connects drain openings 51*a*, 51*b* and 51*c* with coolant outlet pipe 28*a*. Drain manifold segment 47*b* is in full communication with segment 47*a* via connection means 44 and connects drain openings 51*a*, 51*b* and 51*c* with coolant outlet pipe 28*b*. Flexible coolant drain hose 37 connects outlet 28*a* to coolant drain pipe 36*a* while flexible coolant drain hose 35 connects outlet 28*b* and coolant drain pipe 36*b*. Quick release or other coupling means may be used to connect the hoses and pipes. The coolant collection means to which coolant drain pipes 36*a* and 36*b* are connected will preferably utilize jet or other pump means to quickly and efficiently drain the coolant from the roof 10. Any suitable other means to assist draining of the coolant from the roof or furnace shell may also be utilized.

Although they are not used as such during left-handed operation of the furnace roof system as shown in FIGS. 1, 2, 2*a* and 5, a second coolant connection means which may be used in a right-handed installation of roof 10 is provided. This second or right-handed coolant connection means comprises coolant inlet 40 and coolant outlet 42. The left and right-handed coolant connection means are on opposite sides of roof 10 relative to a line passing through mast pivot point 24 and the center of the roof, and lie in adjacent quadrants of the roof. As with left-handed coolant inlet pipe 26, right-handed coolant inlet pipe 40 is connected to inlet manifold 29. As with the left-handed coolant outlet 28, right-handed coolant outlet 42 includes separate outlet pipes 42*a* and 42*b* which communicate with the separate segments 47*a* and 47*b* of the coolant drain manifold which are split by partition 50. To prevent coolant from escaping through the right-handed coolant connection means during installation of roof 10 in a left-handed system, the present invention also provides for capping means to seal the individual roof coolant inlets and outlets. A cap 46 may be secured over the opening to coolant inlet 40. A removable U-shaped conduit or pipe connector 44 connects and seals the separate coolant outlet openings 42*a* and 42*b* to prevent leakage from the roof and to provide for continuity of flow between drain manifold segments 47*a* and 47*b* around partition 50. Where the draining coolant is under suction, connector 44 also prevents atmospheric leakage into the drain manifold sections.

During operation of the furnace roof as installed in a left-handed furnace roof system, coolant would enter from coolant circulation means through coolant pipe 30, through hose 31, and into coolant inlet 26 whereupon it would be distributed around the interior of the roof by inlet manifold 29. Coolant inlet 40, also connected to inlet manifold 29, is reserved for right-handed installation use and therefore would be sealed off by cap 46. After coolant is sprayed from nozzles 34 on spray headers 33 to cool the roof bottom 38, the coolant is collected and received through drain openings 51*a*, 51*b* and 51*c* into the drain manifold extending around the periphery of the roof 10 and exits through coolant outlet 28. As seen in FIG. 2, coolant draining through openings 51*a*, 51*b* and 51*c* on segment 47*a* of the drain manifold many exit the roof directly through coolant outlet 28*a*, through outlet hose 37 and into drain outlet pipe 36*a* before being recovered by the coolant collection means. Coolant draining through openings 51*a*, 51*b* and 51*c* on segment 47*a* of the drain manifold may also travel through coolant outlet 42*b* , through U-shaped connector 44, and back through coolant outlet 42*a* into manifold segment 47*b* in order to pass around partition 50. The coolant would then drain from drain manifold segment 47*b* through coolant outlet 28*b*, outlet hose 35 and through drain pipe 36*b* to the coolant collection means. Right-handed coolant outlet 42 is not utilized to directly drain coolant from the roof, but is made part of the draining circuit through the use of U-shaped connector 44. Upon being drained from the roof, the coolant may either be discharged elsewhere or may be recirculated back into the roof by the coolant system. Left-handed coolant connection means 26 and 28 are positioned on roof 10 closely adjacent to the location of mast structure 14 to minimize hose length. Viewing the mast structure 14 as being located at a 6 o'clock position, the left-handed coolant connection means is located at a 7 to 8 o'clock position.

Figure 3A:
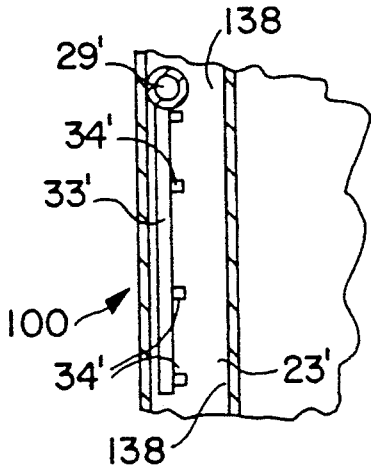
FIG. 3*a* is an enlarged partial view of the sectional portion of FIG. 3.

The spray cooled system as above described can be utilized with molten material furnaces in roof systems, as above described or with other components such as steel furnace side walls, as shown at 100 in FIG. 3 and FIG. 3*a* and other spray cooled furnace system components such as steel ducts for carrying gases from the furnace.

Figure 6:
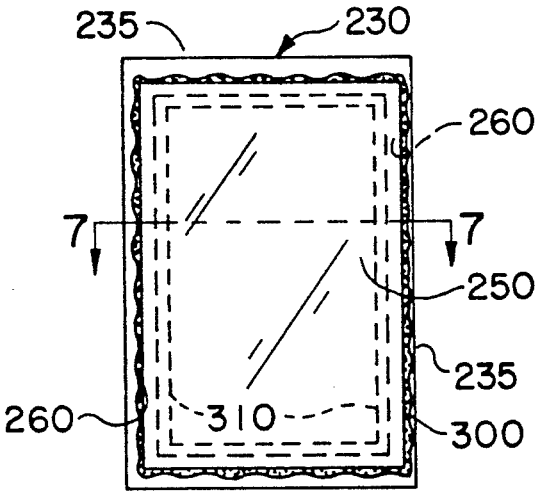
FIG. 6 shows the frame of FIG. 5*a* with a copper plate in register therewith.
Figure 7:
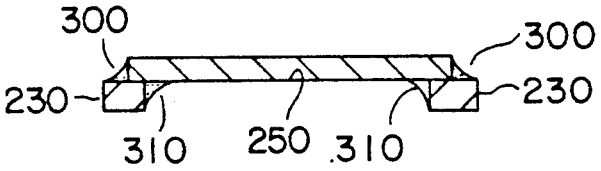
FIG. 7–7*c* show weld configurations related to FIG. 6.
Figure 7A:
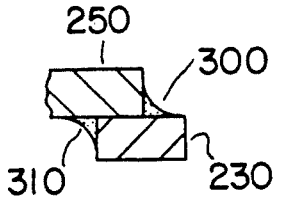
Figure 7B:
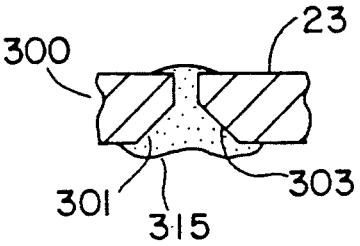
Figure 7C:
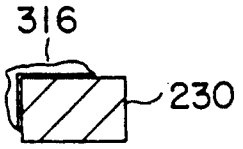
Figure 8:
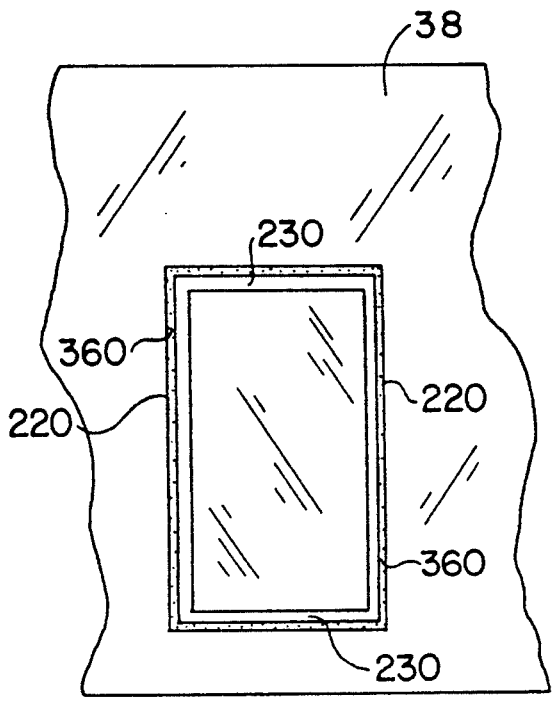
FIG. 8 shows the assembly of the present invention welded into place in a spray cooled plate.
Figure 8A:
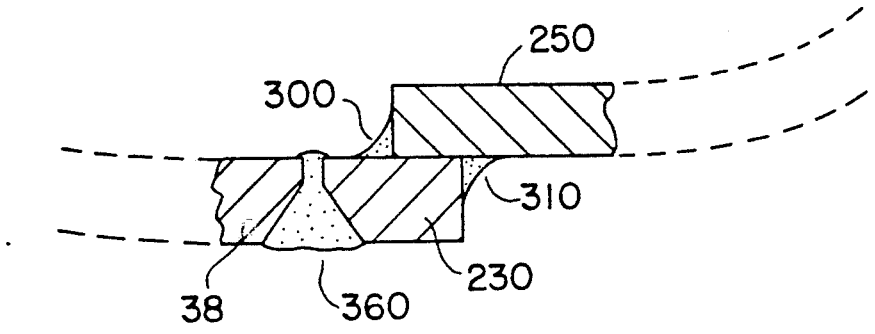
FIG. 8*a* shows welds related to FIG. 8.

In the operation of a furnace system as above described, a spray cooled unitary closure element, such as the frusto-conically shaped carbon steel roof inner plate 38 shown in FIGS. 2, 2*a* and 3, or cylindrically shaped carbon steel side wall unitary closure element inner plate 138, shown in FIGS. 3, 3*a* may be exposed to significantly increased amounts of radiant thermal energy from the arc or flame within the furnace above the body of molten metal 103, as indicated at 107, when the electrodes are positioned above a flat molten metal batch, or as indicated at 107, when the electrodes begin to bore-in to a scrap charge 109. These conditions result in higher temperatures and thermal stress at one site, or region, as compared to other portions thereof. This circumstance can occur due to the relative position of the furnace electrodes, oxygen lances, or other non-uniform furnace operating conditions. Such a high thermal stress circumstance is exemplarily represented at region 200 in FIG. 4, which is exposed to increased radiant energy 107' and FIG. 2*a* for spray cooled inner roof plate closure element 38, but is also applicable to a side wall plate unitary closure element 138 as indicated in FIG. 3. The highly heat stressed condition, or region 200 can be detected by routine temperature monitoring, or by visual inspection, or during shut-down which may reveal a slight bulging or erosion at region 200 of spray cooled inner steel plate 38 (or 138). This "bulging" or erosion of the plate would indicate a high thermal stress location. The spray cooled inner plates 38 (or 138) are essentially continuous integral carbon steel plate structures which are formed by welding together separate steel plate shapes, using conventional carbon steel welding techniques, such as electrode or MIG techniques, which are well known and are easily utilized to produce continuous steel plates such as the spray cooled frusto-conical inner roof plate 38 and cylindrical, spray cooled furnace inner side wall plate 138. The inner plates are typically made of carbon steel ⅜ to ⅝ inch in thickness and are commonly several feet in width and several yards in length and formed to a desired cover configuration or furnace shell radius. In the practice of the present invention, during a furnace "shut-down" period, a cut-out 220 is made in the inner plate to remove therefrom the high heat stress plate portion 200, detected for example by signs of bulging or erosion, and leave a substantially straight-sided opening as shown at 220 in FIG. 5, and represented at 220' in FIG. 2*a* and FIG. 4, which can be slightly rounded at the corners, as indicated at 201, to relieve stress. The cut-out opening 220 in steel plate 38 (138) can be made using conventional torch cutting techniques for carbon steel, e.g., plasma arc torch or acetylene torch techniques. In order to address the high heat stress condition at the site of steel plate portion 200, above molten metal body 103, an integral frame 230, shown in FIG. 5*a*, is formed from carbon steel plate preferably of the same thickness as plate 38 (138) e.g. by use of a cutting torch and the dimensions of the outer periphery 235 of the frame 230 are made so that the frame 230 fits closely within the cut-out 220 in the unitary steel plate closure element 38 leaving only a narrow peripheral space 240 sufficient to enable welding of the frame 230 to steel plate closure element 38 as hereinafter described. A plate of copper, 250, suitably of about the same thickness as frame 230, is provided with dimensions such that its outer peripheral portion 260 abuts, and in a particular embodiment overlaps a portion of frame 230 when placed in register with frame 230 as shown in FIG. 6 and FIG. 7. With carbon steel frame 230 and copper plate 250 abutting and in register, the sub assembly is placed horizontally in an oven, suitably a fire brick oven, to commence the task of welding the copper plate 250 to carbon steel frame 230. The sub assembly of copper plate 250 and steel frame 230 is heated to 800° F. in the fire brick furnace and at this temperature a suitable weld of nickel or copper metal using a stick electrode for a nickel weld and copper wire with MIG techniques is applied to join the copper plate and steel frame as shown at 300, 310 in FIG. 7 and 7*a*. The copper plate 250 is welded at its entire outer periphery to the steel frame 230 so that a gas-tight and water-tight seal is established between the steel frame 230 and copper plate 250. After applying the welds 300, 310 to the peripheral portion of copper plate 250 which abuts frame 230, the welded assembly of the frame and plate can be placed in a close fit in the cut-out 220 in carbon steel plate 38 and the carbon steel frame 230 is welded to the carbon steel plate 38 of the integral furnace system component as indicated at 360 in FIG. 8 and FIG. 8*a*, without any need for pre-heating or other techniques required in the welding of copper to steel. With the above-described assembly of the present invention, the copper plate, being of higher thermal conductivity than steel, relieves the thermal stress at the high temperature radiant heat location and the steel frame is easily welded to the steel closure element. Also, the relative closeness in the values of CTE for copper and carbon steel avoides thermal expansion problems. FIG. 7*b* illustrates an alternate weld configuration wherein the steel frame 230 and copper plate 250 are placed in line with their opposing edges 301, 303 being prepared to receive a butt weld 315. In order to facilitate the welding of the copper plate to the carbon steel frame, the frame can be provided with nickel "buttering" indicated at layer 316 indicated in FIG. 7*c*, which can be deposited from a welding rod or wire. The nickel layer 316 will serve to retard migration of iron from frame 230 to the weld and thus ensure the integrity of the weld. In a preferred embodiment, the frame 235 and plate 250 are formed to have the same degree of curvature as the portion of the plate which it replaces so that upon installation, the steel frame-copper plate assembly and steel plate form a continuous plate structure of substantially the same shape as the original steel plate.

Typically, the frame 235 is formed from plain carbon steel ⅜ to ⅝ inch thick and the frame is about 3 inches wide. The copper plate is typically ½ inch thick and the frame-copper plate assembly can be made in advance in suitable sizes, e.g. 2 feet by 2 feet, 3 feet by 3 feet, to be readily available when and if needed to fit in a cut-out in a steel closure element, typically 10 to 30 feet in diameter and 5 to 15 feet in width, and welded thereto.

What is claimed is:

1. Pre-formed assembly for closing and filling a cut-out region formed in a high thermal stress region of a spray cooled steel plate which forms a unitary closure element of a furnace system adapted to contain molten metal, said region being subjected to heat energy from inside the furnace system and being spaced from molten metal in the furnace system, said pre-formed assembly comprising (i) a continuous steel frame of the same thickness as said spray cooled steel plate having an outer periphery to closely fit within said cut-out region of the steel plate to enable welding of the steel frame to said steel plate at the entire outer periphery of the steel frame (ii) a solid copper plate in register with said steel frame having an outer periphery abutting said steel frame, said solid copper plate being welded at its entire outer periphery to said steel frame so that a gas-tight and water-tight seal is established between the steel frame and copper plate.

2. In an apparatus for use in conjunction with a vessel containing a body of molten metal, said apparatus having a closure element formed of a unitary inner plate and means for directing a spray of fluid coolant against the unitary inner plate for maintaining an acceptable temperature of said plate; the improvement for replacing a pre-determined cut-out portion of said unitary inner plate of said closure element which is spaced from the body of molten metal to lower the temperature at a site in the unitary inner plate of said pre-determined cut-out portion, said improvement comprising a pre-formed assembly welded to said pre-determined cut-out portion of said unitary inner plate including (i) a steel frame having dimensions and an outer periphery whereby the outer periphery of said steel frame fits closely in the site of the cut-out portion, said outer periphery of said steel frame being welded to said pre-determined cut-out portion of said unitary inner plate, (ii) a solid copper plate having a peripheral edge portion which abuts an which is pre-welded to said steel frame along its entire peripheral edge portion, said assembly having the same shape as said cut-out portion and forming a permanently fixed portion of said unitary inner plate.

3. Pre-formed assembly in accordance with claim 1 in the form of a portion of a frusto-conically shaped furnace roof.

4. Pre-formed assembly in accordance with claim 1 in the form of a portion of a cylindrically shaped furnace side wall.

5. Apparatus in accordance with claim 2 wherein said vessel is part of a furnace system.

* * * * *

UNITED STATES PATENT AND TRADEMARK OFFICE

CERTIFICATE OF CORRECTION

PATENT NO. : 5,327,453

DATED : July 5, 1994

INVENTOR(S) : M.T. ARTHUR ET AL

It is certified that error appears in the above-identified patent and that said Letters Patent is hereby corrected as shown below:

Title page, item

[73] Assignee:

"Ucar Caron" should be -- UCAR Carbon --

Signed and Sealed this

Third Day of January, 1995

Bruce Lehman

*Attest:*

BRUCE LEHMAN

*Attesting Officer*

*Commissioner of Patents and Trademarks*